United States Patent [19]

Borona et al.

[11] 4,163,881

[45] Aug. 7, 1979

[54] CIRCUIT BREAKER WITH THRUST TRANSMITTING SPRING

[75] Inventors: Russell T. Borona, Bridgeport; Kenneth R. Coley, Fairfield, both of Conn.

[73] Assignee: Westinghouse Electric Corp., Pittsburgh, Pa.

[21] Appl. No.: 837,656

[22] Filed: Sep. 29, 1977

[51] Int. Cl.[2] ..... H01H 3/00

[52] U.S. Cl. ..... 200/153 G; 200/153 SC

[58] Field of Search ..... 200/16 C, 39 R, 61.76, 200/67 B, 67 C, 70, 153 G, 153 SC, 325; 337/52, 59, 154, 317, 345

[56] References Cited

U.S. PATENT DOCUMENTS

| | | | |
|---|---|---|---|
| 2,690,486 | 9/1954 | Wilckens | 200/153 G |
| 3,286,067 | 11/1966 | Menickella et al. | 200/153 G |
| 3,412,351 | 11/1968 | Harper | 200/153 G |
| 3,480,900 | 11/1969 | Gelzheiser et al. | 200/153 G |

*Primary Examiner*—Joseph Man-Fu Moy

*Attorney, Agent, or Firm*—L. P. Johns

[57] ABSTRACT

A circuit breaker having an improved compact thrust transmitting spring for opening the contacts in a minimum of time.

2 Claims, 7 Drawing Figures

FIG.5
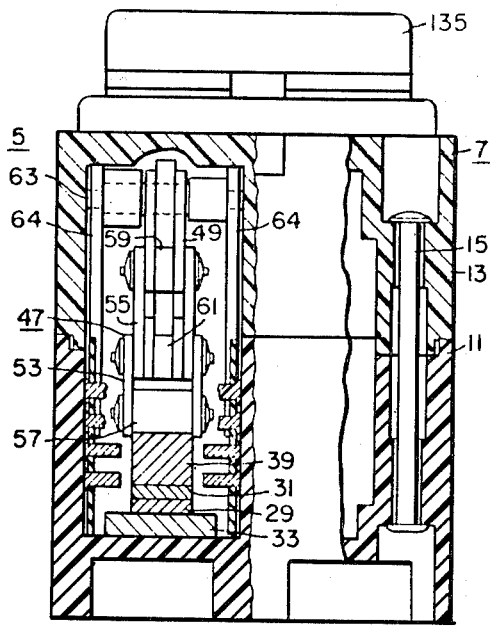
FIG.6
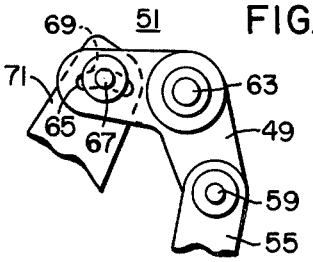
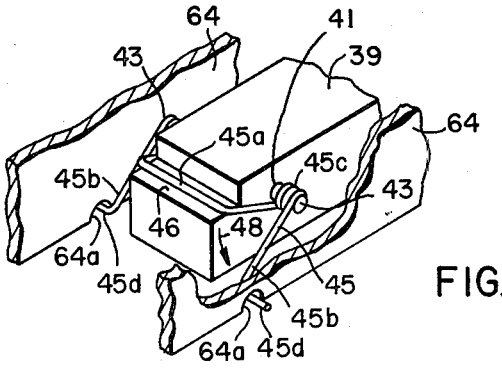
FIG.7

CIRCUIT BREAKER WITH THRUST TRANSMITTING SPRING

BACKGROUND OF THE INVENTION

1. Field of the Invention

This invention relates to a circuit breaker having a thrust transmitting spring for facilitating opening of the contacts.

2. Description of the Prior Art

Generally, the circuit breaker of the type involved herein comprises a pair of separable contacts, an overcenter toggle mechanism for opening and closing the contacts, and a current responsive tripping mechanism for releasably latching the overcenter toggle mechanism. The tripping mechanism functions magnetically or thermally to release the overcenter toggle mechanism after a predetermined current overload or integral of time is involved. Such circuit breakers are disclosed in U.S. Pat. Nos. 3,480,900, 3,492,614, and 3,559,156.

In the past the circuit breakers have been provided with biasing springs for facilitating the operation of the toggle mechanism and in some constructions the provision of an additional spring for increasing the contact opening forces. A disadvantage of those prior devices has been that slot-type pivot construction has been used in conjunction with the additional spring and has thereby resulted in less efficient opening of the contact carrying arm than has been anticipated.

SUMMARY OF THE INVENTION

In accordance with this invention it has been found that the foregoing disadvantage may be overcome by providing a circuit breaker comprising a stationary contact, a movable contact, a contact arm carrying said movable contact, a trip structure, a toggle comprising a first link pivotally connected to said contact arm and a second link pivotally connected to said trip structure, a knee pivot pivotally connecting said first and second links, a manually operable operating member, a thrust-transmitting link between the said operating member and said knee pivot, said operating member being manually pivotable to a closed position to operate through said thrust-transmitting link to cause said toggle to thrust said contact arm to the closed position, the contact arm is pivotally mounted on a fixed axis, bias means are provided for biasing the contact arm to the open position to effect faster separation of the contacts, the bias means comprising a wire spring operatively connected to thrust the contact arm open when the trip structure is operated, the pivot mounting comprising a pivot pin on which the contact arm is rotatably mounted, the wire spring including a coiled portion around the pivot pin, the wire spring also including a first end portion on one side of the coiled portion engaging the contact arm and a second end portion engaging an adjacent fixed member of the circuit breaker, and the spring being in a charged condition when the contacts are closed.

The advantage of the circuit breaker of this invention is that it reduces contact arm sway which heretofore caused interruption problems and increases contact arm speed in opening by the use of a wire spring and a single pivot point for the contact arm. The circuit breaker mechanism provides a contact arm that functions with a spring in conjunction with a single pivot point as compared with prior designs that used a slot-type pivot construction. Usage of the rear contact arm spring and fixed pivot also offers the advantage of increased contact opening in both the trip free and center trip positions, which is very advantageous to short circuit interruption.

BRIEF DESCRIPTION OF THE DRAWINGS

FIG. 5 is a sectional view, with parts shown in elevation and with parts broken away, taken generally along the line V—V of FIG. 2;

FIG. 6 is a view illustrating the connection between the releasable trip member, angle-link and upper toggle link; and FIG. 7 is a fragmentary isometric view illustrating the manner in which a thrust transmitting spring is operatively connected to a contact arm and mounting pin therefor.

DESCRIPTION OF THE PREFERRED EMBODIMENT

Figure 1:
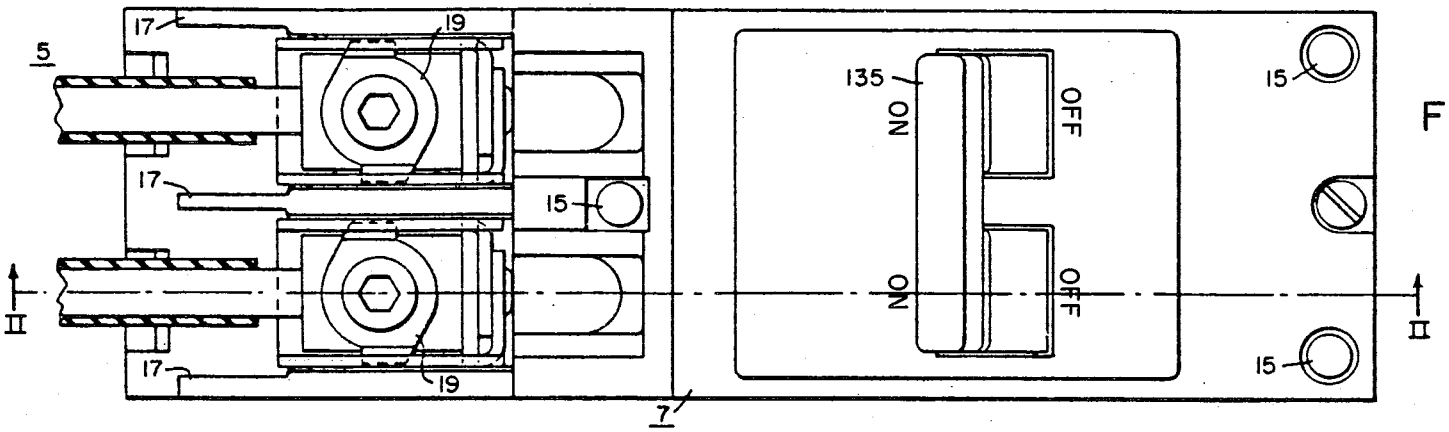
FIG. 1 is a top plan view of a multi-pole circuit breaker constructed in accordance with principles of this invention.

In the drawings, a circuit breaker is generally indicated at 5 and it comprises an insulating housing 7 and a circuit-breaker structure 9 supported on the housing 7.

The insulating housing 7 is a two-part housing comprising a base 11, having a generally planar bottom, and a cover 13 secured to the base 11 by means of three rivets 15. The base 11, at one end thereof, comprises insulating barriers 17 forming two adjacent cavities. The cavities are open at the top and open at the one end of the housing for receiving two clamp-type terminals 19 that are used to connect conducting lines to the multi-pole units. The terminals 19 are more specifically described in the U.S. Pat. No. 3,559,156 of Kenneth R. Coley. The base 11 and cover 13 cooperate to form two adjacent compartments 21 for housing the circuit breaker parts of the multi-pole units.

Each of the circuit-breaker structures 9 comprises an operating mechanism 23, trip structure 25, and a trip device 27. A separate circuit-breaker structure 9 is supported in each of the compartments 21.

Figure 2:
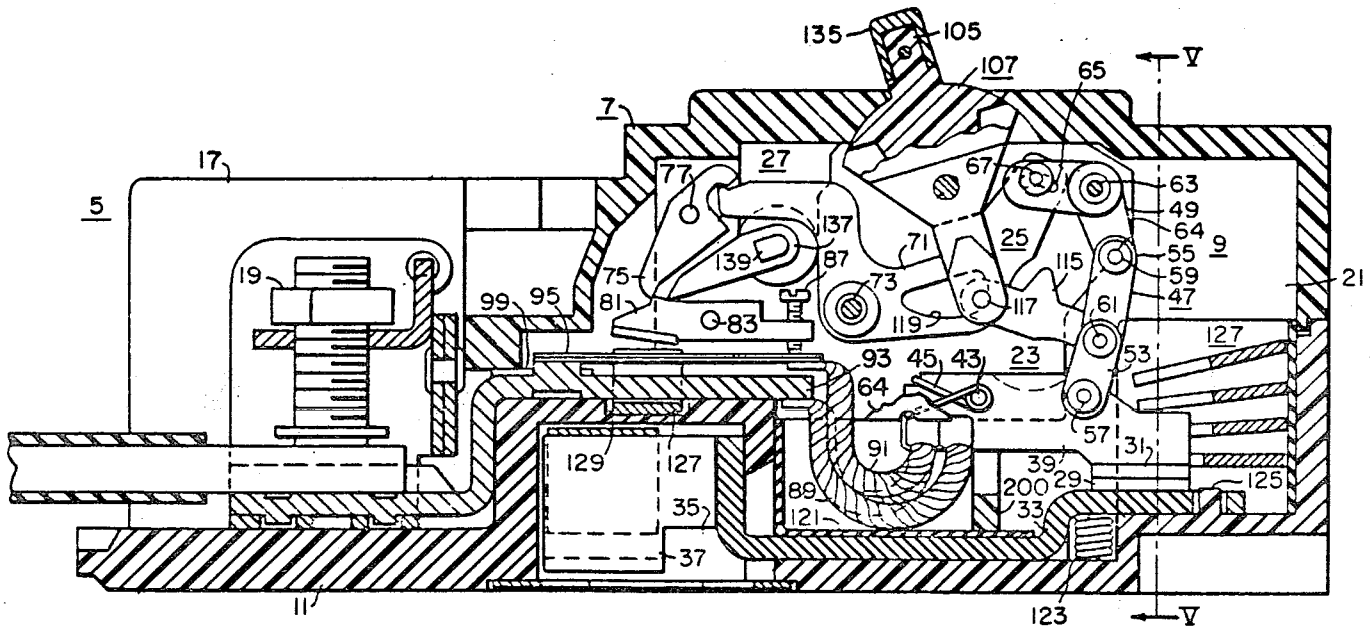
FIG. 2 is a sectional view taken generally along the line II—II of FIG. 1 showing the breaker in an "on" position.
Figure 4:
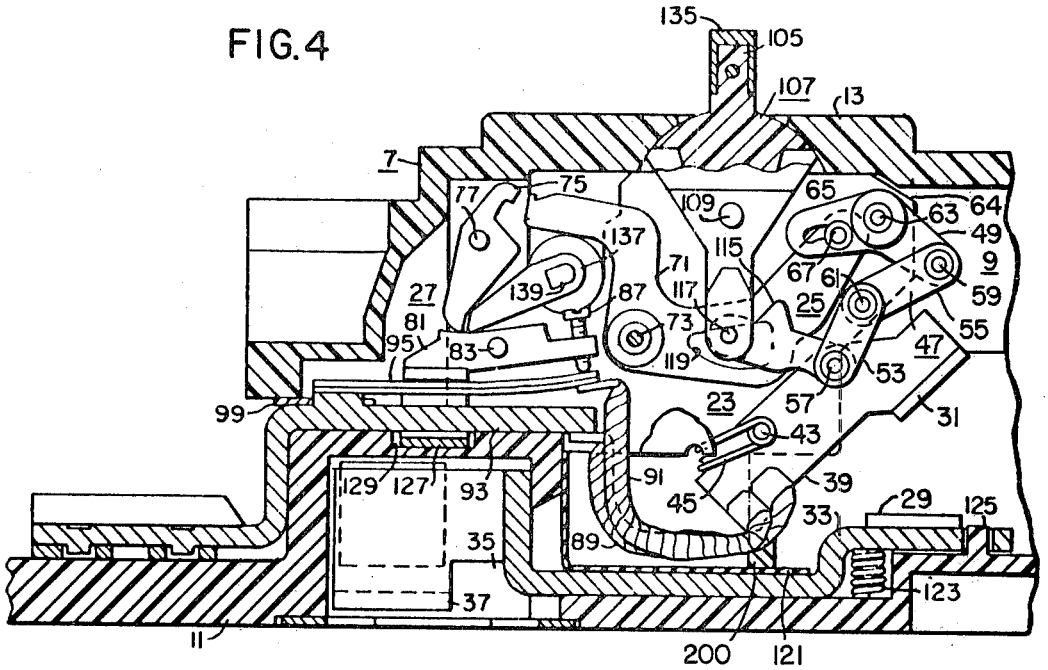
FIG. 4 is a sectional view of the breaker in the tripped position.
Figure 3:
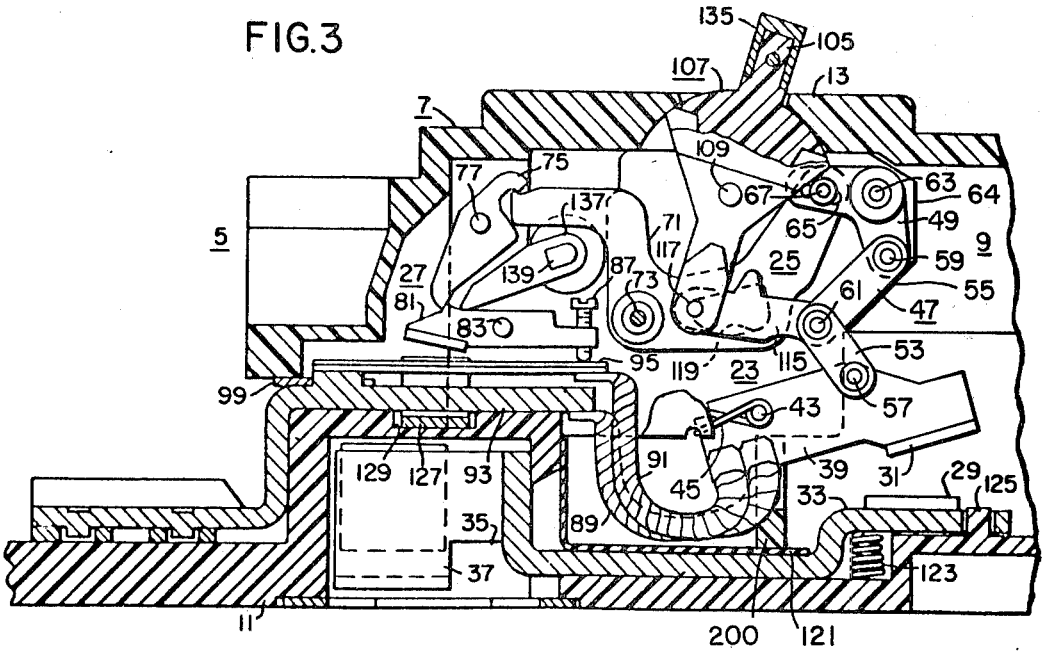
FIG. 3 is a sectional view of the breaker in the "off" position.

Since the parts of the multi-pole units of the circuit breaker are identical, only the pole unit seen in FIGS. 2–4 will be specifically described.

The operating mechanism 23 (FIG. 2) comprises a stationary contact 29 and a movable contact 31. The stationary contact 29 is fixedly secured to a rigid conductor 33 that extends toward the one end into a cavity 35, formed in the base 11, where the conductor 33 is connected to or is part of a clip-on type terminal 37 that is supported in the cavity 35. The cavity 35 is open at the bottom of the base 11 for receiving a stab conductor that would protrude into the cavity 35 to be engaged by the clip-on type connector 37. The movable contact 31 is fixedly secured to an elongated contact arm 39. The contact arm 39 has a pinhole 41 therein for receiving a supporting pin 43. A torsion spring 45 biases the one end of the contact arm 39 to the position in FIG. 3. A toggle 47 connects the contact arm 39 with an angle-link 49 of a trip structure 51. The toggle 47 comprises a lower toggle link 53 and a upper toggle link 55. The lower toggle link 53 is pivotally connected to the contact arm 39 by means of a pin 57 and the upper toggle link 55 is pivotally connected to one leg of the angle-link 49 by means of a pin 59. The toggle links 53 and 55 are pivotally connected by means of a knee pivot pin 61. The angle-link 49 comprises two legs that are angularly spaced and movable as a unit. The angle-link 49 is mounted on a fixed pivot 63 that is supported between a pair of rigid side plates 64 that are supported in the associated compartment. Only one of the side plates 64 is shown in FIG. 2, and both of the side plates are seen in FIG. 5.

The links 53, 47, and 49 are twin links in that each of these links comprises a pair of spaced link members. As shown in FIG. 6, the other leg of the angle-link 49 provided with a slot 65 therein for receiving a pin 67 that also extends through an opening 69 in a releasable cradle member or trip member 71. The pin 67 moves in the slot 65 and opening 69 permitting relative movement between the angle-link 49 and the trip member 71 during tripping and resetting operations. The trip member 71 is pivotally supported, intermediate the ends thereof, on and between the side plates 64, by means of a pin 73. The trip member 71 is maintained in the latched position (FIG. 2) by means of the trip device 27.

The trip device 27 comprises a latch member 75 that is pivotally supported, intermediate the ends thereof, between the side plates 64 on a pin 77. The upper end of the latch 75 engages the trip member 71 to latch the trip member 71 in the position shown in FIG. 2. The lower end of the latch member 75 is latched by means of a latch member 81 that is pivotally supported intermediate the ends thereof on a pin 83 that is supported between the side plates 64. A calibrating screw 87 is threadedly supported on one end of the latch member 81 for holding the member 81 in the position shown.

In the closed position of the circuit breaker 5, a circuit extends from the plug-in line terminal 37 through the conductor 33, stationary contact 29, movable contact 31, contact arm 39, parallel flexible conductors 89 and 91, parallel conducting paths 93 and 95, through the left-hand (FIG. 2) part of the conductor 93 to a conducting line that may be connected to the conductor 93 by means of the clamp-type terminal connector 19. The conductor 93 is a rigid conductor that is fixedly secured in the housing 7. As can be seen in FIG. 2, the rigid conductor 93 rests on a generally flat part of the base above the cavity 35. A flexible pad 99 is placed over the conductor 93, and when the housing cover 13 is tightly riveted down against the base 11 the pad 99 and rigid conductor 93 are sandwiched between the cover 13 and base 11 so that the clamping force of the rivets 15 (FIG. 5) operates to fixedly secure the rigid conductor 93 within the housing. The main conducting path between the contact arm 39 and clamp-type terminal 19 is through the rigid conductor 93. A parallel conducting path is provided through the flexible conductor 91 and bimetal 95 to heat the bimetal 95 to thermally trip the circuit breaker in a manner to be hereinafter specifically described. In FIG. 2, the bimetal 95 is supported at the left end thereof on the rigid conductor 93, and the free end of the bimetal 95 is free to flex in an upward (FIG. 2) direction to trip the circuit breaker.

It is noted in FIG. 2 that the housing is provided with an opening in the front thereof. A handle port 105 of an insulating operating member 107 protrudes through the opening to permit manual operation of the circuit breaker. The insulating operating member 107 is pivotally supported on the side plates 64 by means of a pin 109. A link member 115 is pivotally connected, at one end thereof, to the knee 61 of the toggle 47. The link 115 is pivotally connected at the other end thereof to the lower end of the operating member 107 by means of a pin 117. The pin 117 moves in an opening 119 in the trip member 71.

The circuit breaker is shown in FIG. 2 in the closed position with a generally L-shaped insulating member 121 insulating the rigid conductor 33 from the conductors that are positioned above the insulating member 121. A coil compression spring 123 is positioned under the rigid conductor 33 to bias the conductor 33 upward to provide contact pressure between the contacts 29, 31 in the closed position of the contacts. The housing base is provided with an insulating projection 125 that extends into an opening in the conductor 33 to prevent substantial lateral movement of the conductor 33. Upward movement of the conductor 33 is limited by an insulating member 200 that is held down by the plates 64 that are in turn held down by the cover 13. An arc-extinguishing structure 127 is provided for extinguishing arcs drawn between the contacts during opening operations.

The circuit breaker is shown in the closed position in FIG. 2. When it is desired to manually operate the circuit breaker to the open position, the operating member 107 is pivoted from the "on" position (FIG. 2) to the "off" position (FIG. 3). During this movement, the operating member 107 operates through the link 115 to move the knee 61 of the toggle 47 to the left whereupon the erected toggle 47 collapses moving the contact arm 39, toggle 47, link 115 and operating member 107 to the open position. The opening operation is effected by the force of the worker manually moving the operating member 107 which force is aided by the forces of the springs 123 and 45.

In accordance with this invention the contact arm 39 (FIG. 7) is mounted for pivotal movement on the pin 43, the opposite ends of which are secured in corresponding apertures in the side plates 64. The spring 45 is a wire spring having an intermediate portion **45*a*, corresponding end portions 45*b* and corresponding coil portions 45*c* (only one of which is shown in FIG. 7). The intermediate portion 45*a* extends across a surface 46 of the contact arm 39 and is disposed between the pair of coil portions 45*c*. The coil portions 45*c* are on the outer end portions of the pivot pin 43. The end portions 45*b* of the spring extend from the coil portions 45*c* and are provided with out-turned extremities 45*d* which extend through similar notches 64*a* along the lower edges of the side plates 64. Thus, the spring 45 applies the pressure on the contact arm 39 in a counterclockwise direction indicated by the arrow 48 around the pivot pin 43, so that when the trip structure 25 is unlatched the spring 45 immediately rotates the contact arm counterclockwise to open the contacts 29, 31**.

When it is desired to manually operate the circuit breaker to the closed position, the operating member 107 is manually operated from the "off" position (FIG. 3) to the "on" position (FIG. 2). During this movement, the link 115 is driven by the operating member 107 to operate the toggle 47 from the collapsed to the erected position. The link 115, which is pivotally connected at one end thereof to the operating member 107 by means of the pin 117 and at the other end thereof to the knee pivot 61 of the toggle 47, serves as a thrust-transmitting connection between the operating member 107 and the knee pivot 61 of the toggle 47. During the initial part of this movement, the contact arm 39 pivots about the pin 43 until the toe of the contact 31 engages the stationary contact 29 whereupon further closing movement of the toggle 47 operates to move the contact arm 39 to the fully closed position. Usage of the rear contact arm spring gains additional opening in the tripped position.

During the manual opening and closing operations of the circuit breaker, the angle-link 51 is stationary to maintain the pivot 59 of the upper toggle link 55 fixed. The circuit breaker is tripped open by operation of the trip device 27. In addition to the bimetal 95 the trip device 27 comprises a U-shaped magnetic member 127 supported with the bight portion thereof in a cavity 129 in the base 11 and with the opposite legs thereof extending upward on opposite sides of the rigid conductor 93 and on opposite sides of the bimetal 95. The latch member 81 is magnetic and the left-hand (FIG. 2) end of this member is positioned above the opposite legs of the member 127 whereby the member 81 functions as an armature of an electromagnetic trip structure. An alternative construction would be to make the latch member 81 non-magnetic and to secure a magnetic member to the member 81 above the member 127.

Upon the occurrence of an overload above a first predetermined value and below a second predetermined value, the bimetal 95, which is heated by the heat generated by the current flow therein and which is also heated by the heat generated in the rigid conductor 93, flexes with the free end (on the right) moving upward to engage the calibrating screw 87 to move the latch member 81 in a counterclockwise direction to release the latch member 75. Upon release of the latch member 75, the trip member 71 is released and the contact arm 39 is free to move in the open position under the bias of the spring 45.

Although the main tripping force is exerted by the spring 45, the contact pressure spring 123 provides additional force during the initial movement. The blow-off forces generated by the arc also aid the tripping movement. The contact arm 39 moves from the position shown in FIG. 2 to the tripped position shown in FIG. 4 with the trip member 71 moving clockwise and with the angle-link 51 moving counterclockwise to permit the upper pivot 59 of the toggle 47 to move to release the toggle 47 which collapses to the tripping position of FIG. 4. During the tripped operation, the operating member 107 moves to a tripped position (FIG. 4) intermediate the "on" and "off" positions. Usage of the rear contact arm spring allows for greater opening distance between contacts than previously acquired.

The operating member 107 is stopped in the tripped position by engagement of the pin 117 with an edge of the trip member 71 in the slot 119. When it is desired to reset the circuit breaker for manual operation, the operating member 107 is moved from the tripped position shown in FIG. 4 to a position slightly past the full "off" position shown in FIG. 3. During this movement the pin 117 engages the trip member 71 in the slot 119 to rotate the trip member 71 in a counterclockwise direction. Near the end of this movement of the operating member 107, the end of the trip member 71 engages the latch member 75 moving the latch member clockwise to the latching position, and when the latch member 75 reaches the latching position the spring 85 biases the latch member 81 to the latching position to latch the latch member 75 whereby upon release of the operating member 107 the circuit breaker will be latched in the position shown in FIG. 3.

When the trip member 71 is in the latched position the angle-link 49 is held stationary so that the upper pivot 59 of the toggle 47 is fixed whereby the circuit breaker may be manually operated between the "on" and "off" positions in the same manner hereinbefore described. The slot-and-pin connection between the angle-link 49 and trip member 71 prevents movement of the angle-link 49 when the trip member is latched in a stationary position and permits the relative movement between these parts during the tripping and resetting operations. The angle-link 49 enables a tripping operation of the trip member 71 with the trip member 71 not moving to a position substantially higher within the circuit breaker housing than the original position of the trip member 71 so that the height-wise dimension of the circuit breaker housing can be kept compact.

Upon the occurrence of an overload above the second predetermined value, magnetic flux generated in the members 127, 81 by means of the current flowing through the members 93, 95 causes attraction of the armature 81 to the yoke 127 whereupon the armature 81 moves to the tripped position instantaneously without the time delay of the thermal tripping operation. Upon movement of the latch member 81 to the tripped position the circuit breaker is tripped in the same manner as was hereinbefore described with regard to the thermal tripping operation. The circuit breaker is thereafter reset in the same manner as was hereinbefore described with regard to the resetting operation following the thermal tripping operation.

As was previously set forth, the circuit breaker 5 is a multi-pole circuit breaker with each of the poles constructed as shown in FIGS. 2–6. A handle tie member 135 (FIGS. 1 and 5) connects the handles of the multi-pole units together for simultaneous manual operation. In order to provide that all of the pole units will trip upon the tripping of either of the pole units, a separate member 137 (FIG. 2) is pivotally mounted between the side plates 64 of each of the poles. Each of the members 137 is pivotally supported on a pin 139. The members 137 in the multi-pole units are operatively connected for simultaneous pivotal movement about the same axis. Upon the occurrence of a tripping operation in either pole unit, the associated latch 75 will engage the associated member 137 to cam the member 137 in a counterclockwise (FIG. 2) direction whereupon both of the members 137 will simultaneously move counterclockwise so that the member 137 in the adjacent pole unit will engage that armature 81 to move the armature 81 in the adjacent pole unit to the tripped position. When the circuit breaker is reset the armatures 81 engage the members 137 to move the members 137 to the position shown in FIG. 2.

In conclusion, the thrust transmitting mechanism for the contact arm provides the combination of a wire spring and a single pivot point to enable the contact arm to move move effectively and efficiently than was possible in prior constructions, because of the improved mechanical advantage of the structure set forth above. As a result of the faster movement of the contact arm and increased contact separation, there is better arc interruption between the contacts. Moreover, due to single point pivot action, rather than slot type pivot, the contact arm rotates in one plane and thereby reduces a tendancy of old style action to cock and bind upon opening. This is also important in maintaining a central position of the contact arm within arc plate opening. Finally, the wire spring is disposed at the end of the contact arm remote from the contacts whereby hot debris fails to reach and deteriorate the spring.

What is claimed is:

1. In a circuit breaker having a stationary contact, a movable contact, a contact arm carrying said movable contact, a trip structure, a toggle comprising a first link pivotally connected to said contact arm and a second link pivotally connected to said trip structure, a knee pivot pivotally connecting said first and second links, a manually operable operating member, a thrust-transmitting link between the said operating member and said knee pivot, said operating member being manually movable to a closed position to operate through said thrust-transmitting link to cause said toggle to thrust said contact arm to the closed position, the improvement wherein the contact arm is pivotally mounted on a pinhole axis, bias means for biasing the contact arm to the open position to effect increased separation of the contacts and comprising a wire spring pivoted on the pinhole axis and having first and second end portions, the movable contact being mounted on one side surface of the contact arm, the first end portion of the wire spring bearing against the opposite side surface of the arm, and the second end portion of the spring being fixedly mounted.

2. The circuit breaker of claim 1 in which the contact arm rotates between open and closed positions on a pivot pin on the fixed pivot axis.

* * * * *